US007001504B2

(12) United States Patent
Schoonover

(10) Patent No.: US 7,001,504 B2
(45) Date of Patent: Feb. 21, 2006

(54) METHOD FOR EXTRACTION OF ORGANOSULFUR COMPOUNDS FROM HYDROCARBONS USING IONIC LIQUIDS

(75) Inventor: Roger E. Schoonover, Lawrence, KS (US)

(73) Assignee: Extractica, LLC., Beaverton, OR (US)

( * ) Notice: Subject to any disclaimer, the term of this patent is extended or adjusted under 35 U.S.C. 154(b) by 513 days.

(21) Appl. No.: 10/289,931

(22) Filed: Nov. 6, 2002

(65) Prior Publication Data

US 2003/0085156 A1 May 8, 2003

Related U.S. Application Data

(60) Provisional application No. 60/331,076, filed on Nov. 6, 2001.

(51) Int. Cl.
*C10G 21/00* (2006.01)

(52) U.S. Cl. ..... 208/236; 208/237; 208/208 R

(58) Field of Classification Search ..... 208/236, 208/237, 208 R
See application file for complete search history.

(56) References Cited

U.S. PATENT DOCUMENTS

| | | | | |
|---|---|---|---|---|
| 4,539,596 | A | 9/1985 | Elabd | 585/856 |
| 5,167,797 | A | 12/1992 | Ou | 208/236 |
| 5,220,106 | A | 6/1993 | Boate et al. | 585/865 |
| 5,304,615 | A | 4/1994 | Ambler et al. | 526/189 |
| 5,344,555 | A | 9/1994 | Roof et al. | 208/189 |
| 5,354,453 | A | 10/1994 | Bhatia | 208/236 |
| 5,494,572 | A | 2/1996 | Horii et al. | 208/263 |
| 5,550,304 | A | 8/1996 | Chauvin et al. | 585/512 |
| 5,744,024 | A | 4/1998 | Sullivan, III et al. | 208/236 |
| 5,824,832 | A | 10/1998 | Sherif et al. | 585/455 |
| 5,892,124 | A | 4/1999 | Olivier | 568/374 |
| 5,910,440 | A | 6/1999 | Grossman et al. | 435/282 |
| 5,954,949 | A | 9/1999 | Ohsol et al. | 208/131 |
| 6,160,193 | A | 12/2000 | Gore | 585/833 |
| 6,274,026 | B1 | 8/2001 | Schucker et al. | 205/696 |
| 6,274,785 | B1 | 8/2001 | Gore | 585/833 |
| 6,277,271 | B1 | 8/2001 | Kocal | 208/212 |
| 6,339,182 | B1 | 1/2002 | Munson et al. | 585/809 |

FOREIGN PATENT DOCUMENTS

| | | |
|---|---|---|
| WO | WO 200140150 A1 * | 6/2001 |
| WO | WO 02/34863 | 10/2001 |

OTHER PUBLICATIONS

"Technical Summaries on Ionic Liquids in Chemical Processing", pp. 1-30, Aug. 22, 2003.*
"Green Process Uses Ionic Liquid and $CO_2$." *Chemical & Engineering News*, May 10, 1999, p. 9.
"Ionic Liquids Prove Increasingly Versatile." *Chemical & Engineering News*, Jan. 4, 1999, pp. 23-24.
Belen'kii, "Methods of Desulfurization and Their Use in Organic Synthesis." in *Chemistry of Organosulfur Compounds: General Problems*, Belen'kii, ed. (New York, Ellis Horwood, 1990), pp. 206, 210-211.
Bösmann, et al., "Deep Desulfurization of Diesel Fuel by Extraction with Ionic Liquids." *J. Chem. Soc., Chem. Commun.*, 2001, pp. 2494-2495.
Chapados et al., "Desulfurization by Selective Oxidation and Extraction of Sulfur-Containing Compounds to Economically Achieve Ultra-Low Proposed Diesel Fuel Sulfur Requirements." Presented at National Petrochemical & Refiners Association 2000 Annual Meeting, Mar. 26-28, 2000, San Antonio, Texas. AM-00-25.
Cullen et al., "SulphCo—Desulfurization via Selective Oxidation *pilot plant results and commercialization plans*." Presented at National Petrochemical & Refiners Association 2001 Annual Meeting, Mar. 18-20, 2001, New Orleans, Louisiana. AM-01-55.
Huddleston et al., "Room Temperature Ionic Liquids as Novel Media for "Clean" Liquid-Liquid Extraction." *J. Chem. Soc., Chem. Commun.*, 1998, pp. 1765-1766.
Levy et al., "Unipure's ASR-2 Diesel Desulfurization Process: A Novel, Cost-Effective Porcess for Ultra-Low Sulfur Diesel." Presented at National Petrochemical & Refiners Association 2001 Annual Meeting, Mar. 18-20, 2001, New Orleans, Louisiana. AM-01-10.
Mashkina, A.V., "Catalytic Synthesis of Organosulfur Compound." in Belen'kii, *Chemistry of Organosulfur Compounds; General Problems*, (New York, Ellis Horwood, 1990), pp. 174, 184-188.
Simpkins, N.S., "The Preparation of Sulphones," in *Sulphones in Organic Synthesis*, (Oxford, Pergamon Press, 1993), pp. 5-11.
Simpkins, N.S., "Desulphonylation." in *Sulphones in Organic Synthesis*, (Oxford, Pergamon Press, 1993), pp. 334, 346, 351, 365.
Simpkins, N.S., "Chemistry of Cyclic Sulphones." in *Sulphones in Organic Synthesis*, (Oxford, Pergamon Press, 1993), pp. 307-310.
Simpkins, N.S., "Introduction to Sulphone Chemistry." in *Sulphones in Organic Synthesis*, (Oxford, Pergamon Press, 1993), pp. 1-3.
Voronkov et al., "Thermal Reactions and High Temperature Syntheses." in *Chemistry of Organosulfur Compounds; General Problems*, Belen'kii, ed. (New York, Ellis Horwood, 1990), pp. 55-56.
Zannikos et al., "Desulfurization of Petroleum Fractions by Oxidation and Solvent Extraction." *Fuel Processing Technology*, 42:35-45 (1995).

* cited by examiner

*Primary Examiner*—Walter D. Griffin
(74) *Attorney, Agent, or Firm*—Sheridan Ross P.C.

(57) ABSTRACT

A process for the removal of organosulfur compounds from hydrocarbon materials is disclosed. The process includes contacting an ionic liquid with a hydrocarbon material to extract sulfur-containing compounds into the ionic liquid. The sulfur-containing compounds can be partially oxidized to sulfoxides and/or sulfones prior to or during the extraction step.

18 Claims, No Drawings

METHOD FOR EXTRACTION OF ORGANOSULFUR COMPOUNDS FROM HYDROCARBONS USING IONIC LIQUIDS

CROSS-REFERENCE TO RELATED APPLICATION

This application claims the benefit of priority under 35 U.S.C. § 119(e) from U.S. Provisional Application Ser. No. 60/331,076, filed Nov. 6, 2001, which is incorporated herein by reference in its entirety.

FIELD OF THE INVENTION

The field of the invention is the removal of organic sulfur compounds from hydrocarbon materials.

BACKGROUND OF THE INVENTION

The EPA has issued regulations for reducing the level of sulfur in gasoline and diesel fuel. In order to comply with these new regulations, essentially all domestic refineries are forced to install new fuel desulfurization processes. Well-known hydrotreating processes are commercially available. These hydrotreating processes operate at relatively high pressures and use significant amounts of hydrogen. Therefore, these processes require a significant capital investment and have high operating costs. In addition, most gasoline desulfurization processes based on hydrogenation degrade the quality of the gasoline.

In order to reduce the overall cost of desulfurization, several new technologies are being developed which do not utilize conventional hydrotreating technology. Two of the most recognized non-conventional approaches are adsorption of sulfur compounds onto a solid adsorbent and extraction of sulfur compounds into a immiscible liquid phase. Phillips Petroleum has developed technology (U.S. Pat. No. 6,274,031) which utilizes a fluidized bed for adsorption of the sulfur compounds. Regeneration is in an oxygen environment requiring lockhoppers. The process has yet to be commercialized but the capital costs are believed to be higher than conventional hydrotreating. Other technologies based on adsorption such as Pritchard's process (U.S. Pat. No. 5,730,860), have failed to commercialize to date at least partially due to operational concerns and capital cost projections.

A desulfurization technology based on liquid/liquid extraction of the sulfur compounds would be attractive since generally mild conditions would result in lower capital and operating costs. However, a suitable solvent has been difficult to find since the organosulfur compounds in a hydrocarbon mixture generally have physical properties similar to the other organic compounds. One approach is to increase the polarity of the organosulfur compounds by partially oxidizing them and then extracting them into a polar solvent. In U.S. Pat. No. 5,910,440, Grossman, et al. proposed a process to oxidize the sulfur species to sulfoxides and/or sulfones using a microorganism in an aqueous based system. The sulfoxides and/or sulfones are subsequently reduced by a reducing agent in the aqueous phase. U.S. Pat. No. 6,160,193 issued to Gore, also proposed a step-wise process for oxidizing the sulfur compounds using an oxidizing agent such as peroxyacetic acid followed by extraction with a non-miscible solvent such as dimethyl sulfoxide. This process is further explained in a paper, AM-00-25, presented by Petro Star, Inc. at the National Petrochemical and Refiners Association 2000 annual meeting. UniPure Corporation presented an additional paper at the 2001 National Petrochemical and Refiners Association annual meeting, AM-01-10, proposing a similar approach based on an aqueous oxidation. All of these processes utilize a step-wise oxidation/extraction approach. Since the partially oxidized sulfur compounds are not fully extracted by the solvent, a fixed bed adsorption step is required downstream of the extraction step. In addition, these processes consume expensive chemical reagents.

There are other novel technologies being developed. In U.S. Pat. No. 6,274,026, Schucker, et al. propose to polymerize sulfur compounds in an electrochemical cell using an ionic liquid as the electrolyte. The sulfur-containing polymers deposit in electrochemical cell making the separation difficult and resulting in an inefficient batch process.

The present invention described in detail below involves the use of ionic liquids to extract organosulfur compound. The organosulfur compounds may be extracted directly or they may be partially oxidized to sulfoxides and sulfones so as to increase their solubility in the ionic liquids. Ionic liquids are molten salts composed entirely of ions. Molten NaCl is a common example. When the cation is a relatively large organic cation and the anion is, for example, a metal halide, the melting point of the salt is lower such that it is a liquid at room temperature. Room temperature ionic liquids were developed in the 1970's and the early research took place in the U.S. focusing on the use of these materials in batteries. In the 1980's interest developed in using room temperature ionic liquids as solvents for chemical processes, and since then a number of such uses have emerged. Some research has focused on using room temperature ionic liquids in biphasic systems for alkylation and acetylation reactions, "Ionic liquids prove increasingly versatile", *Chemical & Engineering News*, Jan. 4, 1999. Systems using room temperature ionic liquids as solvents to extract organics from aqueous solutions have been developed, "Room temperature ionic liquids as a novel media . . . ", *Chem. Commun.,* 1765–1766, 1998; "Green processing using ionic liquids and $CO_2$, *Chemical & Engineering News*, May 10, 1999.

Institut Francais du Petrole holds over a dozen relevant patents using room temperature ionic liquidsas solvents for alkylation, polymerization, and diels-alder catalysts dating from the early 1990's. For example, U.S. Pat. No. 5,892,124 describes a process for diels-alder reaction in which a room temperature ionic liquid is used as a solvent for a Lewis acid catalyst. U.S Pat. No. 5,550,304 discloses a dimerization process using a quaternary ammonium halide combined with an aluminum halide and/or an alkylaluminum halide as the room temperature ionic liquid.

U.S. Pat. No. 5,304,615 assigned to BP Chemicals provides a butene polymerization using pyridinium or imidazolium chloride combined with an alkylaluminum halide, $R_nAlX_{3-n}$ as the room temperature ionic liquid.

U.S. Pat. No. 5,824,832 assigned to Akzo Nobel describes a process for linear alkylbenzene formation using proprietary room temperature ionic liquids as described in U.S. Pat. No. 5,731,1091 that are made with alkyl amine hydrohalide salts combined with a metal halide.

U.S. Pat. No. 5,220,106 assigned to Exxon discloses a process using an ionic liquid to extract aromatics from a mixed hydrocarbon in which the preferred salt is triethylammonium dihydroxybenzoate. There remains a significant need to develop improved processes for removing sulfur from hydrocarbon materials and for developing novel and beneficial uses of ionic liquids.

SUMMARY OF THE INVENTION

The present invention is directed to a method for reducing the sulfur content of a hydrocarbon material. The method includes contacting the hydrocarbon material with an ionic liquid to extract at least a portion of the sulfur compound from the hydrocarbon material to the ionic liquid. The method further includes separating the hydrocarbon material from the ionic liquid. The hydrocarbon material can be is selected from crude oil, liquefied petroleum gas, gasoline, diesel fuel, jet fuel, home heating oil and portions of the foregoing. The ionic liquid can be selected from the group liquid salts having the general formula $Q^+ A^-$; wherein $Q^+$ is selected from quaternary ammonium cations and quaternary phosphonium cations and $A^-$ represents any anion that forms a liquid salt at below about 100° C. For example, the ionic liquid can have a $Q^+$ cation selected from an alkyl pyridinium cation, a di-alkyl imidazolium cation, a tri-alkyl imidazolium cation and a tri-alkyl amine cation, and an $A^-$ anion selected from the group consisting of a halide anion, nitrate anions, a triflate anion, a hexafluorophosphate anion, a tetrafluoroborate anion, a halogenoaluminate anion, an organohalogenoaluminate anion, an organogallate anion, an organohalogenogallate anion and mixtures thereof. More particularly, the ionic liquid can be N-butylpyridnium hexafluorophosphate, N-ethylpyridinium tetrafluoroborate, tetrabutylphosphonium tetrafluoroborate, 1-butyl-3-methylimidazolium tetrafluoroborate, 1-butyl-3-methylimidazolium hexafluoroantimonate, 1-butyl-3-methylimidazolium hexafluorophosphate, 1-ethyl-3-methylimidazolium hexafluorophosphate, 1-ethyl-3-methylimidazolium triflate, 1-butyl-3-methyl-imidazolium trifluoromethylsulfonate, pyridinium fluorosulfonate, 1-butyl-3-methylimidazolium tetrachloroaluminate, trimethylphenyl-ammonium hexafluorophosphate or trimethyl amine tetrachloroaluminate. The ionic liquid is preferably less than about 10% miscible in the hydrocarbon material. Sulfur compounds that can be removed from the hydrocarbon material can include mercaptans, sulfides, disulfides, thiophenes, benzothiophenes and dibenzothiophenes.

By practice of the present invention, the total sulfur content of the hydrocarbon material can be reduced by substantially any desired extent, such as by at least about 5%, 50%, or 90%.

The hydrocarbon material having a reduced sulfur content can be further treated in a second extraction step by subsequently contacting it with a second ionic liquid to extract additional sulfur from the hydrocarbon material to the second ionic liquid and separating the hydrocarbon material from the second ionic liquid.

The step of contacting can be conducted for between about 1 minute and about 1 hour. The step of contacting can be conducted at a temperature of between about room temperature and about 200° C. The step of contacting can be conducted at a pressure from about atmospheric to about 50 atm.

The steps of contacting and separating can be conducted in a counter-current contactor whereby the hydrocarbon material enters the contactor at the bottom and rises to the top and the ionic liquid enters the contactor at the top and descends to the bottom.

The method can further include regenerating the ionic liquid by removing the sulfur compound from the ionic liquid and contacting additional hydrocarbon material with the ionic liquid from which the sulfur compound has been removed. The step of removing the sulfur compound from the ionic liquid can be selected from heating the ionic liquid to vaporize the sulfur compound, extraction of the sulfur compound from the ionic liquid with another solvent, hydrogen gas stripping, inert gas stripping, vaporization at a reduced pressure, oxidation of the sulfur compounds thereby releasing sulfur dioxide, hydrogenation of the sulfur compounds thereby releasing hydrogen sulfide and supercritical $CO_2$ extraction and combinations of the foregoing techniques.

A further embodiment of the invention is a method for reducing the sulfur content of a hydrocarbon material comprising a sulfur compound that includes partially oxidizing the sulfur compound in the hydrocarbon material, contacting the hydrocarbon material with an ionic liquid, whereby at least a portion of the partially oxidized sulfur compound is extracted from the hydrocarbon material to the ionic liquid and separating the hydrocarbon material from the ionic liquid, whereby the sulfur content of the hydrocarbon material is reduced. The step of partially oxidizing can be selected from chemical oxidation and biocatalytic oxidation. The step of chemically oxidizing can be contacting the hydrocarbon material with an oxidant selected from air, oxygen, ozone, peroxides and peroxyacids. The step of partial oxidation can convert the sulfur compound to a compound selected from sulfoxides and sulfones The step of partially oxidizing can be conducted either prior to or during the step of contacting. The step of partially oxidizing can be conducted by introducing an oxidizing agent which is soluble in the ionic liquid, and optionally, water can be added to the mixture of the ionic liquid and the soluble oxidizing agent. The step of partially oxidizing can be conducted by the injection of a gaseous oxidizing agent into a mixture of the ionic liquid and hydrocarbon material. Also, the step of oxidation can be conducted in the presence of an oxidation catalyst that promotes the partial oxidation of the sulfur compound. The catalyst can contain a transition metal, such as platinum, palladium, vanadium, nickel, salts thereof or oxides thereof.

The method can further include regenerating the ionic liquid by removing the partially oxidized sulfur compound from the ionic liquid and contacting additional hydrocarbon material with the ionic liquid from which the partially oxidized sulfur compound has been removed. For example, when the partially oxidized sulfur compound is a sulfone, the step of regenerating can be a process selected from pyrolytic extrusion of sulfur dioxide from the sulfone and alkylative desulfonylation.

A further embodiment of the present invention is a method for reducing the sulfur content of a hydrocarbon material comprising a sulfur compound. The method includes partially oxidizing the sulfur compound in the hydrocarbon material and contacting the hydrocarbon material with an ionic liquid. The ionic liquid can be selected from liquid salts with general formula $Q^+ A^-$; where $Q^+$ is selected from quaternary ammonium cations and quaternary phosphonium cations and $A^-$ is selected from any anion that forms a liquid salt at below about 100° C. At least a portion of the partially oxidized sulfur compound is extracted from the hydrocarbon material to the ionic liquid, and the hydrocarbon material is separated from the ionic liquid. The process further includes regenerating the ionic liquid by removing the sulfur compound from the ionic liquid and contacting additional hydrocarbon material with the ionic liquid from which the sulfur compound has been removed.

DETAILED DESCRIPTION OF THE INVENTION

The present invention is directed to a method for reducing the sulfur content of hydrocarbon materials. The process of the present invention is based on the recognition that sulfur-based compounds in hydrocarbon materials are more soluble in ionic liquids than in the hydrocarbon material. Thus, the present invention is an extraction process that includes contacting the hydrocarbon material with an ionic liquid, whereby the sulfur-based compounds preferentially report to the ionic liquid phase of the mixed composition. Subsequently, the hydrocarbon material is separated from the ionic liquid and the sulfur content of the hydrocarbon material is reduced. This method overcomes the difficulties associated with processes described above by using an ionic liquid as the extraction solvent for organosulfur compounds. The present method can be performed under relatively mild conditions using common processing operations, which results in low capital costs as well as lower operating costs. Unlike most desulfurization processes based on hydrotreating, the quality of the fuel is not degraded and may be improved.

The present invention is suitable for removing organosulfur compounds from a wide range of hydrocarbon materials. Without limitation, the hydrocarbon material can be selected from crude oil, liquefied petroleum gas, gasoline, diesel fuel, jet fuel, and home heating oil. Also included are portions of the foregoing materials, such as distillation fractions and/or blending components thereof. Hydrocarbon materials contain a variety of different types of organosulfur compounds and may include thousands of different specific compounds. The present invention is generally applicable to removal of all types of sulfur-containing compounds, including mercaptans, sulfides, disulfides, thiophenes, benzothiophenes, and dibenzothiophenes.

Ionic liquids for use in the present invention are molten salts composed of ions. Such ionic liquids are liquid at operating temperatures as disclosed herein. When the cation of a salt is a relatively large organic cation and a suitable anion is selected, the melting point of the salt is decreased such that it is a liquid at relatively low temperatures. For example, suitable liquid salts of the present invention are liquid at temperatures below about 100° C. In alternative embodiments, suitable ionic liquids of the present invention are liquid at temperatures below about 75° C. and below about 50° C.

In a preferred embodiment, the ionic liquid is selected from liquid salts having the general formula $Q^+A^-$, wherein $Q^+$ is selected from quaternary ammonium cations and quaternary phosphonium cations and wherein $A^-$ is selected from any anion that forms a liquid salt at temperatures as described above. A typical anion is often derived from $AlCl_3$. Some of the more common room temperature ionic liquids include [ethyl, methyl imidazolium]$^+$ $[AlCl_4]^-$; [butyl, methyl imidazolium]$^+$ $[AlCl_4]^-$; [N-butyl pyridinium]$^+$ $[AlCl_4]^-$. Ionic liquids have extremely low vapor pressure and are relatively easy and inexpensive to prepare.

Preferred $Q^+$ cations of the present invention are selected from an alkyl pyridinium cation, a di-alkylimidazolium cation, a tri-alkylimidazolium cation and a trialkyl amine cation. Preferred $A^-$ anions are selected from halide anions, nitrate anions, triflate anions, hexafluorophosphate anions, tetrafluoroborate anions, halogenoaluminate anions, organohalogenoaluminate anions, organogallate anions, organohalogenogallate anions and mixtures thereof. More particularly, preferred ionic liquids of the present invention are selected from N-butylpyridinium hexafluorophosphate, N-ethylpyridinium tetrafluoroborate, tetrabutylphosphonium tetrafluoroborate, 1-butyl-3-methylimidazolium tetrafluoroborate, 1-butyl-3-methylimidazolium hexafluoroantimonate, 1-butyl-3-methylimidazolium hexafluorophosphate, 1-ethyl-3-methylimidazolium hexafluorophosphate, 1-ethyl-3-methylimidazolium triflate, 1-butyl-3-methyl-imidazolium trifluoromethylsulfonate, pyridinium fluorosulfonate, 1-butyl-3-methylimidazolium tetrachloroaluminate, trimethylphenyl-ammonium hexafluorophosphate and trimethyl amine tetrachloroaluminate. Ionic liquids are selected for use in the present invention such that they are essentially immiscible with the hydrocarbon material being treated. For example, it is preferred that the ionic liquid be less than about 10% miscible in the hydrocarbon material at room temperature, more preferably less than about 5% miscible, and even more preferably, less than about 1%. Further, suitable ionic liquids can be selected if upon mixing with an equal amount of the hydrocarbon material being treated, the ionic liquid and the hydrocarbon material, when left to settle, separate into two visibly distinct phases.

The present invention is successful in removing sulfur containing compounds from hydrocarbon materials. As will be appreciated by those skilled in the art, the amount of sulfur removed from hydrocarbon material will depend on the process design, including length of contact time, use of multiple extraction steps, etc. More particularly, the total sulfur content of hydrocarbon materials can be reduced by at least about 5% by use of the present invention. More preferably, the total sulfur content of hydrocarbon materials can be reduced by at least about 50%, more preferably at least about 75%, more preferably at least about 90%, more preferably at least about 95%, and more preferably at least about 99%. Thus, it will be appreciated that in some circumstances only small reductions in sulfur content are necessary, for example, to reduce the sulfur content of a hydrocarbon fuel that only slightly exceeds the mandated sulfur standard. In other circumstances, it may be the goal of a user to attain the maximum possible sulfur reduction.

In a preferred embodiment of the present invention, multiple extraction steps are used. Specifically, after the steps of contacting hydrocarbon material with an ionic liquid to extract sulfur compounds from hydrocarbon material and separating the ionic liquid, an additional extraction step is conducted. Thus, the hydrocarbon material in which the sulfur content has been reduced is then contacted with a second ionic liquid in a further extraction step. As will be appreciated, the second ionic liquid can be the same or different from the ionic liquid used in the first extraction step. Moreover, processes can be designed which include two, three or more extraction steps in a series.

The process of the present invention can be conducted on either a batch or a continuous basis. In a preferred embodiment of the present invention, the steps of contacting and separating are conducted on a continuous basis in a countercurrent contactor. In such a device, the hydrocarbon material is introduced to the bottom of a contactor vessel and the ionic liquid is introduced to the contactor vessel at the top. As the hydrocarbon material rises to the top and the ionic liquid descends to the bottom of the vessel, the two materials contact each other and the sulfur compounds are extracted into the ionic liquid phase. As the materials further rise and descend to the exit of the contactor, respectively, the separation step occurs, as well. The hydrocarbon material is then taken off from the top of the vessel and ionic liquid is taken off from the bottom of the vessel.

The length of time for the step of contacting in which sulfur compounds are extracted from the hydrocarbon material to the ionic liquid is a process design variable, and is conducted for any suitable length of time, depending upon the process configuration and desired results. Longer contact times will achieve more complete desulfurization; however, in order to reduce capital cost requirements, it is typically desirable to minimize the contact time as much as possible while still achieving the desired degree of desulfurization. The amount of contact time will depend to a large extent upon the degree of mixing during the extraction and other design variables. For example, the step of contacting can be conducted anywhere from about one minute to about one hour.

The step of contacting the hydrocarbon material with an ionic liquid can be conducted at any suitable temperature for the process in question, and moderate variations in temperature will typically only have minor effects on performance. It should be noted that ionic liquids are preferably selected such that the extraction step can be conducted at a relatively low temperature. Acceptable results for the process of the present invention can be achieved from anywhere between about room temperature and about 200° C., more preferably between about 20° C. and about 100° C., and more preferably between about 30° C. and about 50° C.

Similarly, the pressure at which the step of contacting the hydrocarbon material and the ionic liquid is conducted can be selected from a wide range of possibilities for any given process design. For a given design temperature, it is generally only necessary to operate at a high enough pressure so as to maintain the hydrocarbon in a liquid phase. For example, suitable pressures range from about atmospheric pressure to about 50 atm.

Once the extraction step is complete, the desulfurized hydrocarbon material and the ionic liquid are separated. A wide variety of liquid/liquid separation techniques are known to those skilled in the art. Such techniques include, for example, decanting and centrifugation.

The ionic liquid of the present invention can be regenerated after the sulfur-containing compounds are extracted from a hydrocarbon material by removing the sulfur compounds from the ionic liquid. Such regenerated ionic liquids can then be used in additional extraction steps. Removal of sulfur compounds from an ionic liquid can be conducted by a variety of techniques that are well known to those skilled in the art. Such techniques can be selected from heating the ionic liquid to vaporize the sulfur compound, extraction of the sulfur compound from the ionic liquid with another solvent, hydrogen gas stripping, inert gas stripping, vaporization at a reduced pressure, oxidation of the sulfur compounds thereby releasing sulfur dioxide, hydrogenation of the sulfur compounds thereby releasing hydrogen sulfide, supercritical $CO_2$ extraction and combinations of any of the foregoing techniques. The resulting sulfur compounds, and any nitrogen compounds, which are simultaneously extracted, can be further processed to recover the hydrocarbon portion of the compound in process units known to one skilled in petroleum refining, such as a hydrotreating unit or a coking unit.

Regeneration of ionic liquid by removal of sulfur species is an important step when the process is being conducted on a continuous basis. It will be appreciated that as the concentration of sulfur compounds in the ionic liquid builds to a certain level, the efficiency of transfer from the hydrocarbon phase to the ionic liquid phase will be impaired. Therefore, by removal of the sulfur compounds from the ionic liquid, the efficiency of the extraction process will be maintained at a higher level.

In another embodiment of the present invention, sulfur compounds in the hydrocarbon material are partially oxidized prior to or during the step of contacting the hydrocarbon material with an ionic liquid. The step of partial oxidation of sulfur-containing compounds makes the compounds more polar, thereby facilitating extraction of them into the ionic liquid. More particularly, partial oxidation of the sulfur-containing compounds in hydrocarbon materials forms sulfoxides and/or sulfones, thereby increasing the polarity of the sulfur-containing compounds. In the case where the hydrocarbon material is gasoline, the mild oxidizing atmosphere may generate desirable oxygenated compounds in the fuel. The step of partial oxidation can be conducted either by chemical oxidation or biocatalytic oxidation. For example, an ionic liquid with or without the addition of water can be used as a media for a biocatalyst. The use of a biocatalyst for the partial oxidation of sulfur compounds is described more fully in U.S. Pat. No. 5,910,440. Using an ionic liquid containing a biocatalyst for partial oxidation of the sulfur compounds enables the biocatalytic oxidation of the sulfur compounds and the simultaneous extraction of the resulting sulfoxides and/or sulfones into the ionic liquid.

Chemical oxidation of sulfur compounds in the hydrocarbon material to form sulfoxides and/or sulfones can be conducted by contacting the hydrocarbon material with any known oxidant, as can be selected by one skilled in the art. For example, oxidants such as air, oxygen, ozone, peroxide, and peroxyacids are suitable. Further, the step of partial oxidation can be conducted prior to or during the step of contacting the hydrocarbon material with an ionic liquid. For example, partial oxidation during the step of contacting can be achieved by introducing to the ionic liquid an oxidizing agent that is soluble or suspended in the ionic liquid. In this embodiment, water can be added to the mixture of the ionic liquid and the soluble oxidizing agent. The step of partial oxidation can also be achieved during the step of contacting by the injection of a gaseous oxidizing agent into the mixture of the ionic liquid and hydrocarbon material.

In a further embodiment, the step of partial oxidation of sulfur compounds is conducted in the presence of an oxidation catalyst that promotes the partial oxidation of the sulfur compound. Suitable oxidation catalysts will be recognized by those skilled in the art. For example, a suitable catalyst is one that contains a transition metal. More particularly, the catalyst, in preferred embodiments, can be selected from the group of platinum, palladium, vanadium, nickel, salts of the foregoing, and oxides of the foregoing.

In the embodiment of the present invention including partial oxidation of sulfur compounds, the ionic liquid can also be regenerated for subsequent use. All of the techniques for regeneration of the ionic liquid discussed above in the more general description of the invention are suitable for this embodiment, as well. In addition, in this particular embodiment, the ionic liquid can be regenerated when the oxidized sulfur compound is a sulfone and the step of regenerating includes the pyrolytic extrusion of sulfur dioxide from the sulfone. Pyrolytic extrusion is a known method of eliminating sulfur from a sulfone and is further described in "Sulphones in Organic Synthesis"; Simpkins, N.; 346–347; 1993. Sulfones are generally heated to 170° C. to 390° C. and yield sulfur dioxide and sulfur-free olefins. The thermal cleavage of cyclic sulfones has also been documented at low temperatures (100° C.) and low pressures (100 mm Hg); as summarized in "Chemistry of Organosulfur Compounds"; Belen'Kii, L.; 210–212; 1990. An ionic liquid provides a preferred media for this regeneration reaction. In addition, a catalyst may be added to the ionic liquid to promote this regeneration reaction. Another method of regeneration of the ionic liquid is by alkylative desulfonylation as described by Simpkins. The ionic liquid is not only regenerated by this process but the resulting sulfur-free hydrocarbon will be more valuable.

All publications and patents referenced herein are incorporated herein by reference in their entireties.

The following examples are provided for the purpose of illustration and are not intended to limit the scope of the present invention.

Examples 1–8 illustrate desulfurization by the direct extraction of sulfur compounds with ionic liquids:

EXAMPLES

Example 1

A low sulfur model gasoline was prepared by mixing 570 g of 1-hexene, 190 g of cyclohexane, 665 g of n-hexane and 475 g of o-xylene. A high sulfur model gasoline was prepared by mixing a 493 g portion of the low sulfur model gasoline with 0.48 g of pentanethiol, 0.73 g of methylthiophene and 0.77 g of benzothiophene. This high sulfur model gasoline was analyzed with a Perkin Elmer Autosystem gas chromatograph with a 50 m high performance capillary column. The sulfur content as determined by the pentanethiol, methylthiophene and benzothiophene gas chromatograph peaks was 1,182 ppm by weight. In a small vial, 2 ml of the high sulfur model gasoline was mixed with 2 ml of ethyl methyl imidazolium triflate that was purchased from Sigma Aldrich. The two-phase mixture was shaken by hand at room temperature for approximately 5 minutes. The mixture was allowed to set for approximately 5 minutes; the ionic liquid formed a bottom layer. Approximately 1 g of the extracted model gasoline was decanted off with a pipette and a sample was analyzed using the same gas chromatograph. The sulfur content of the extracted gasoline was 1,038 ppm.

Example 2

In a small vial, 2 ml of the high sulfur model gasoline from Example 1 was mixed with 2 ml of ethyl methyl imidazolium hexafluorophosphate which was purchased from Sigma Aldrich. The two-phase mixture was shaken by hand at room temperature for approximately 5 minutes. The mixture was allowed to set for approximately 5 minutes; the ionic liquid formed a bottom layer. The extracted model gasoline was decanted off with a pipette and a sample was analyzed using the same gas chromatograph. The sulfur content of the extracted gasoline was 1,101 ppm.

Example 3

An ionic liquid was synthesized by combining 60 g of butyl methylimidazolium chloride with an equal molar amount (45.86 g) of aluminum chloride. In a small vial, 2 ml of the high sulfur model gasoline from Example 1 was mixed with 2 ml of the butyl methyl imidazolium tetrachloroaluminate. The two-phase mixture was shaken by hand at room temperature for approximately 5 minutes. The mixture was allowed to set for approximately 5 minutes; the ionic liquid formed a bottom layer. Approximately 1 g of the extracted model gasoline was decanted off with a pipette and a sample was analyzed using the same gas chromatograph. The sulfur content of the extracted gasoline was 754 ppm.

Example 4

An ionic liquid was synthesized by combining 20 g of the equal molar butyl methylimidazolium tetrachloroaluminate from Example 3 with an additional 2 g of aluminum chloride thus forming an Lewis acidic ionic liquid. In a small vial, 2 ml of the high sulfur model gasoline from Example 1 was mixed with 2 ml of the Lewis acidic butyl methyl imidazolium tetrachloroaluminate. The two-phase mixture was shaken by hand at room temperature for approximately 5 minutes. The mixture was allowed to set for approximately 5 minutes; the ionic liquid formed a bottom layer. Approximately 1 g of the extracted model gasoline was decanted off with a pipette and a sample was analyzed using the same gas chromatograph. The sulfur content of the extracted gasoline was 1,032 ppm.

Example 5

An ionic liquid was synthesized by combining 20 g of the equal molar butyl methylimidazolium tetrachloroaluminate from Example 3 with an additional 1.0 g of aluminum chloride thus forming an Lewis acidic ionic liquid. In a small vial, 2 ml of the high sulfur model gasoline from Example 1 was mixed with 2 ml of the Lewis acidic butyl methyl imidazolium tetrachloroaluminate. The two-phase mixture was shaken by hand at room temperature for approximately 5 minutes. The mixture was allowed to set for approximately 5 minutes; the ionic liquid formed a bottom layer. Approximately 1 g of the extracted model gasoline was decanted off with a pipette and a sample was analyzed using the same gas chromatograph. The sulfur content of the extracted gasoline was below the detection limit of the gas chromatograph, approximately 100 ppm.

Example 6

An ionic liquid was synthesized by combining 20 g of the equal molar butyl methylimidazolium tetrachloroaluminate from Example 3 with an additional 0.7 g of aluminum chloride thus forming an Lewis acidic ionic liquid. In a small vial, 2 ml of the high sulfur model gasoline from Example 1 was mixed with 2 ml of the Lewis acidic butyl methyl imidazolium tetrachloroaluminate. The two-phase mixture was shaken by hand at room temperature for approximately 5 minutes. The mixture was allowed to set for approximately 5 minutes; the ionic liquid formed a bottom layer. Approximately 1 g of the model gasoline was decanted off with a pipette and a sample was analyzed using the same gas chromatograph. The sulfur content of the extracted gasoline was below the detection limit of the gas chromatograph, approximately 100 ppm.

Example 7

In a small vial, 2 ml of the high sulfur model gasoline from Example 1 was mixed with 2 ml of butyl methyl imidazolium hexafluorophosphate. The two-phase mixture was shaken by hand at room temperature for approximately 5 minutes. The mixture was allowed to set for approximately 5 minutes; the ionic liquid formed a bottom layer. The extracted model gasoline was decanted off with a pipette and a sample was analyzed using the same gas chromatograph. The sulfur content of the extracted gasoline was 928 ppm.

Example 8

In a small vial, 2 ml of the high sulfur model gasoline from Example 1 was mixed with 2 ml of trimethyl amine chloroaluminate which was purchased for Sigma Aldrich. The two-phase mixture was shaken by hand at room temperature for approximately 5 minutes. The mixture was allowed to set for approximately 5 minutes; the ionic liquid formed a bottom layer. The extracted model gasoline was decanted off with a pipette and a sample was analyzed using the same gas chromatograph. The sulfur content of the extracted gasoline was below the detection limit of the gas chromatograph, approximately 100 ppm.

Examples 9–15 illustrate desulfurization by extraction of partially oxidized sulfur compounds with ionic liquids:

Example 9

A model gasoline was prepared by mixing 72 g of o-xylene and 1.0 g of benzothiophene sulfone that was purchased from Sigma Aldrich. The initial sulfur content was calculated to be 2058 ppm by weight. In a small vial, 10 ml of this model gasoline was mixed with 2 ml of butyl methyl imidazolium hexafluorophosphate. The two-phase mixture was shaken by hand at room temperature for approximately 5 minutes. The mixture was allowed to set for approximately 5 minutes; the ionic liquid formed a bottom layer. Approximately 1 g of the model gasoline was decanted off with a pipette. The sulfur content of the extracted gasoline was 821 ppm as determined by UV fluorescence per ASTM D 5453.

Example 10

A model gasoline was prepared by mixing 23.3 g of o-xylene and 0.39 g of dimethyl sulfone. The sulfur content of the model gasoline was 1142 ppm as determined by UV fluorescence per ASTM D 5453. In a small vial, 4.96 g of the model gasoline was mixed with 3.02 g of butyl methyl imidazolium hexafluorophosphate. The two-phase mixture was shaken by hand at room temperature for approximately 5 minutes. The mixture was allowed to set for approximately 5 minutes; the ionic liquid formed a bottom layer. The model gasoline layer was centrifuged to remove a hazy appearance. Approximately 1 g of the model gasoline was decanted off with a pipette. The sulfur content of the extracted gasoline was 45 ppm by ASTM D 5453.

Example 11

A model gasoline was prepared by mixing 50 g of the low sulfur model gasoline from Example 1 with 0.135 g of benzothiophene sulfone. The sulfone did not easily dissolve. The mixture was heated slightly in order to dissolve a majority of the sulfone. The sulfur content of this model gasoline was 66 ppm as determined by UV fluorescence per ASTM D 5453. In a small flask, 30 g of this model gasoline was mixed with 30 g of butyl methyl imidazolium hexafluorophosphate. The two-phase mixture was shaken by hand at room temperature for approximately 5 minutes. The mixture was allowed to set for approximately 5 minutes; the ionic liquid formed a bottom layer. The model gasoline layer was centrifuged. Approximately 1 g of the model gasoline was decanted off with a pipette. The sulfur content of the extracted gasoline was 3 ppm by ASTM D 5453. In a second small flask, 23.6 g of the extracted model gasoline from the first extraction was mixed with 23.6 g of fresh butyl methyl imidazolium hexafluorophosphate. The two-phase mixture was shaken by hand at room temperature for approximately 5 minutes. The mixture was allowed to set for approximately 5 minutes; the ionic liquid formed a bottom layer. The model gasoline layer was centrifuged. Approximately 1 g of the model gasoline was decanted off with a pipette and a sample was analyzed using the same gas chromatograph. The sulfur content of the extracted gasoline was below the detection limit of 1 ppm by ASTM D 5453.

Example 12

A low sulfur model diesel was prepared by mixing 100 ml of hexadecane and 100 ml of methylnaphthlene. A high sulfur diesel was prepared by mixing 50 g of the low sulfur diesel with 0.135 g of benzothiophene sulfone. The sulfur content of this high sulfur model diesel was 3456 ppm as determined by UV fluorescence per ASTM D 5453. In a small flask 44.9 g of the high sulfur model diesel was mixed with 50 g of butyl methyl imidazolium hexafluorophosphate. The two-phase mixture was shaken by hand at room temperature for approximately 5 minutes. The mixture was allowed to set for approximately 5 minutes; the ionic liquid formed a bottom layer. The extracted model diesel layer was centrifuged to remove a haze. Approximately 1 g of the model diesel was decanted off with a pipette. The sulfur content of the extracted diesel was 2309 ppm by ASTM D 5453. The ionic liquid layer from this first extraction was regenerated by heating on a hot plate in a small flask with a stirring bar. Nitrogen was bubbled through the ionic liquid. The ionic liquid was gently heated for approximately 1 hour. In a small flask 14.2 g of the extracted model diesel from the first extraction was mixed with 14.2 g of the regenerated ionic liquid. The two-phase mixture was shaken by hand at room temperature for approximately 5 minutes. The mixture was allowed to set for approximately 5 minutes; the ionic liquid formed a bottom layer. The extracted model diesel layer was centrifuged. Approximately 1 g of the model diesel was decanted off with a pipette. The sulfur content of the extracted diesel was 1967 ppm by ASTM D 5453. This demonstrated that the ionic liquid had been at least partially regenerated since the sulfur content was reduced below 2309 ppm which was achieved in the first extraction.

Example 13

In a small flask 15 g of the model diesel from the first extraction in Example 12 having a sulfur content of 2309 ppm by ASTM D 5453 was mixed with 15 g of fresh butyl methyl imidazolium hexafluorophosphate. The two-phase mixture was shaken by hand at room temperature for approximately 5 minutes. The mixture was allowed to set for approximately 5 minutes; the ionic liquid formed a bottom layer. The extracted model diesel layer was centrifuged. Approximately 1 g of the model diesel was decanted off with a pipette. The sulfur content of the extracted diesel was 1567 ppm by ASTM D 5453.

Example 14

In a small flask 8.7 g of the model diesel from the second extraction in Example 13 having a sulfur content of 1567 ppm by ASTM D 5453 was mixed with 8.7 g of fresh butyl methyl imidazolium hexafluorophosphate. The two-phase mixture was shaken by hand at room temperature for approximately 5 minutes. The mixture was allowed to set for approximately 5 minutes; the ionic liquid formed a bottom layer. The extracted model diesel layer was centrifuged. Approximately 1 g of the model diesel was decanted off with a pipette. The sulfur content of the extracted diesel was 1070 ppm by ASTM D 5453.

Example 15

In a small flask 3.9 g of the model diesel from the third extraction in Example 14 having a sulfur content of 1070 ppm by ASTM D 5453 was mixed with 3.9 g of fresh butyl methyl imidazolium hexafluorophosphate. The two-phase mixture was shaken by hand at room temperature for approximately 5 minutes. The mixture was allowed to set for approximately 5 minutes; the ionic liquid formed a bottom layer. The extracted model diesel layer was centrifuged. In a small flask 3.2 g of the model diesel from the fourth extraction was mixed with 3.2 g of fresh butyl methyl imidazolium hexafluorophosphate. The two-phase mixture was shaken by hand at room temperature for approximately 5 minutes. The mixture was allowed to set for approximately 5 minutes; the ionic liquid formed a bottom layer. The extracted model diesel layer was centrifuged. In a small flask 2.8 g of the model diesel from the fifth extraction was mixed with 2.8 g of fresh butyl methyl imidazolium hexafluorophosphate. The two-phase mixture was shaken by hand at room temperature for approximately 5 minutes. The mixture was allowed to set for approximately 5 minutes; the ionic liquid formed a bottom layer. The extracted model diesel layer was centrifuged. Approximately 1 g of the model diesel was decanted off with a pipette. The sulfur content of the extracted diesel after six stages of extraction was 301 ppm by ASTM D 5453.

While various embodiments of the present invention have been described in detail, it is apparent that modifications and adaptations of those embodiments will occur to those skilled in the art. It is to be expressly understood, however, that such modifications and adaptations are within the scope of the present invention, as set forth in the following claims.

What is claimed is:

1. A method for reducing the sulfur content of a hydrocarbon material comprising a sulfur compound, comprising:

a. partially oxidizing the sulfur compound in the hydrocarbon material to form oxidation products comprising products selected from the group consisting of sulfoxides and sulfones;

b. contacting the hydrocarbon material with an ionic liquid, whereby at least a portion of the partially oxidized sulfur compound is extracted from the hydrocarbon material to the ionic liquid; and c. separating the hydrocarbon material from the ionic liquid, whereby the sulfur content of the hydrocarbon material is reduced.

2. The method, as claimed in claim 1, wherein the step of partially oxidizing is selected from the group consisting of chemical oxidation and biocatalytic oxidation.

3. The method, as claimed in claim 1, wherein the step of partially oxidizing is chemical oxidation by contacting the hydrocarbon material with an oxidant selected from the group consisting of air, oxygen, ozone, peroxides and peroxyacids.

4. The method, as claimed in claim 1, wherein the step of partially oxidizing is conducted prior to the step of contacting.

5. The method, as claimed in claim 1, wherein the step of partially oxidizing is conducted during the step of contacting.

6. The method, as claimed in claim 5, wherein the step of partially oxidizing is conducted by introducing an oxidizing agent which is soluble in the ionic liquid.

7. The method, as claimed in claim 6, wherein water is added to the mixture of the ionic liquid and the soluble oxidizing agent.

8. The method, as claimed in claim 5, wherein the step of partially oxidizing is conducted by the injection of a gaseous oxidizing agent into a mixture of the ionic liquid and hydrocarbon material.

9. The method, as claimed in claim 1, wherein the step of contacting is conducted for between about 1 minute to about one hour.

10. The method, as claimed in claim 1, wherein the step of contacting is conducted at a temperature of between about room temperature and about 200° C.

11. The method, as claimed in claim 1, wherein the step of contacting is conducted at a pressure from about atmospheric to about 50 atm.

12. The method, as claimed in claim 1, wherein the step of oxidation is conducted in the presence of an oxidation catalyst that promotes the partial oxidation of the sulfur compound.

13. The method, as claimed in claim 12, wherein the catalyst contains a transition metal.

14. The method, as claimed in claim 12, wherein the catalyst is selected from the group consisting of platinum, palladium, vanadium, nickel, salts thereof and oxides thereof.

15. The method, as claimed in claim 1, further comprising regenerating the ionic liquid by removing the partially oxidized sulfur compound from the ionic liquid and contacting additional hydrocarbon material with the ionic liquid from which the partially oxidized sulfur compound has been removed.

16. The method, as claimed in claim 15, wherein the partially oxidized sulfur compound is a sulfone and the step of regenerating comprises a process selected from the group consisting of pyrolytic extrusion of sulfur dioxide from the sulfone and alkylative desulfonylation.

17. The method, as claimed in claim 1, wherein the step of oxidizing converts the sulfur compound to a compound selected from the group consisting of sulfoxides and sulfones.

18. A method for reducing the sulfur content of a hydrocarbon material comprising a sulfur compound, comprising:

a. partially oxidizing the sulfur compound in the hydrocarbon material to form oxidation products comprising products selected from the group consisting of sulfoxides and sulfones;

b. contacting the hydrocarbon material with an ionic liquid selected from the group consisting of liquid salts with general formula $Q^+ A^-$; *where* $Q^+$ is selected from quaternary ammonium cations and quaternary phosphonium cations and $A^{31}$ is selected from any anion that forms a liquid salt at below about 100° C., whereby at least a portion of the partially oxidized sulfur compound is extracted from the hydrocarbon material to the ionic liquid;

c. separating the hydrocarbon material from the ionic liquid, whereby the sulfur content of the hydrocarbon material is reduced; and d. regenerating the ionic liquid by removing the sulfur compound from the ionic liquid and contacting additional hydrocarbon material with the ionic liquid from which the sulfur compound has been removed.

* * * * *